US005581265A

United States Patent [19]

Stirland et al.

[11] Patent Number: 5,581,265

[45] Date of Patent: Dec. 3, 1996

[54] REFLECTOR ANTENNA ASSEMBLY FOR DUAL LINEAR POLARIZATION

[75] Inventors: Simon J. Stirland; Dharam P. S. Malik, both of Stevenage, Great Britain

[73] Assignee: Matra Marconi Space UK Limited, Middlesex, England

[21] Appl. No.: 309,496

[22] Filed: Sep. 23, 1994

Related U.S. Application Data

[63] Continuation of Ser. No. 3,429, Jan. 12, 1993, abandoned.

[30] Foreign Application Priority Data

Feb. 1, 1992 [GB] United Kingdom ..... 9202176

[51] Int. Cl.[6] ..... H01Q 19/14

[52] U.S. Cl. ..... 343/756; 343/781 P; 343/781 R

[58] Field of Search ..... 343/781 P, 756, 343/753, 840, 909, 781 R, 755; H01Q 19/14

[56] References Cited

U.S. PATENT DOCUMENTS

| | | | |
|---|---|---|---|
| 3,096,519 | 7/1963 | Martin | 343/909 |
| 3,810,185 | 5/1974 | Wilkinson | 343/756 |
| 3,898,667 | 8/1975 | Raab | 343/756 |
| 4,284,992 | 8/1981 | Gans | 343/781 P |
| 4,625,214 | 11/1986 | Parekh | 343/781 P |
| 4,647,938 | 3/1987 | Roederer et al. | 343/756 |
| 4,823,143 | 4/1989 | Bockrath | 343/781 P |
| 5,160,937 | 11/1992 | Fairlie et al. | 343/781 P |

FOREIGN PATENT DOCUMENTS

| | | |
|---|---|---|
| 45254 | 2/1982 | European Pat. Off. . |
| 1268341 | 3/1972 | United Kingdom . |
| 2182806 | 5/1987 | United Kingdom . |
| 88044880 | 6/1988 | WIPO . |

*Primary Examiner*—Hoanganh Le
*Attorney, Agent, or Firm*—Cushman, Darby & Cushman

[57] ABSTRACT

A reflector antenna assembly for dual linear polarization includes at least two feeds and two reflectors. At least one reflector has a surface which is nominally electrically transparent to linearly polarized radiation in one direction and is located in front of the other reflector so as to be closer to said feeds. At least one of the reflectors is profiled in a manner such as to enable it to generate at least one complex contoured beam while using one of said feeds.

12 Claims, 1 Drawing Sheet

REFLECTOR ANTENNA ASSEMBLY FOR DUAL LINEAR POLARIZATION

This is a continuation of application Ser. No. 08/003,429, filed on Jan. 12, 1993, now abandoned.

FIELD OF THE INVENTION

This invention relates to a reflector antenna assembly for dual linear polarization suitable for the generation of contoured beams.

BACKGROUND OF THE INVENTION

At least two reflector antenna assemblies are known for generation of contoured beams in dual linear polarization. A first such known assembly is an assembly of dual offset shaped reflectors in which the polarization reuse is obtained from a high quality feed interfaced to an ortho mode transducer (OMT) feeding a dual reflector assembly of inherently low cross polarization. In such an assembly an offset subreflector, preferably ellipsoidal cancels the cross polarization of an offset solid profiled main reflector which generates the required beam shape. The subreflector and main reflector generally face towards one another and are spaced apart with corrugated feed interfaced to the ortho-mode transducer being located between the two reflectors and pointing towards the subreflector. Thus radiation from the feed is reflected from the subreflector to the solid profiled main reflector. Such a known dual offset shaped reflector assembly is relatively cumbersome in size, is greatly influenced by thermal misalignment due to the use of a subreflector, requires a very complex feed means and is unable to generate different contoured beam shapes on the two polarizations.

Contoured beams may also be generated in dual linear polarization by the use of a conventional gridded antenna assembly. Such an assembly utilizes two gridded reflectors in which the front is transparent to radiation intended for reflection from the rearmost antenna. Both reflectors are of simple conic section profile which requires the use of complex multiple feed clusters to generate contoured beams. The use of such complex multiple feed clusters has the disadvantage of producing feed mutual coupling with difficult to predict effect resulting in discrepancies in pattern shape between predicted and measured beam contours or patterns. Such multi feed antenna assemblies also suffer from beam forming network losses with consequent reduction in gain and the difficulty in generating overlapping beams without feed sharing.

OBJECTS OF THE INVENTION

Thus one object is to provide a generally improved reflector antenna assembly for dual linear polarization which at least minimizes the foregoing disadvantages of conventional assemblies.

This and other objects and advantages of the present invention will become more apparent from details disclosed in the following specification where preferred embodiments of the invention are described.

SUMMARY OF THE INVENTION

According to the present invention there is provided a reflector antenna assembly for dual linear polarization, including at least two feeds and two reflectors, at least one of which reflectors has a surface which is nominally electrically transparent to linearly polarized radiation in one direction and is located in front of the other reflector so as to be closer to said feeds, and at least one of which reflectors is profiled in a manner such as to enable it to generate at least one complex contoured beam whilst using one of said feeds.

Preferably said at least one reflector which is located in front of the other reflector and which has the nominally electrically transparent surface, has conducting grids on said surface so as to remain transparent to signals polarized orthogonally to the grids whilst being able to reflect signals polarized parallel to the grids.

Conveniently the rearmost of said reflectors with respect to the feeds has, on a surface thereof, conducting grids extending in a direction orthogonal to the conducting grids on said front located reflector.

Advantageously the rearmost of said reflectors with respect to the feeds is uniformly electrically conducting. Preferably the reflector located in front with respect to said feeds is profiled or shaped to generate a contoured or shaped beam so as to have a footprint which covers only a predetermined area of ground.

Conveniently the rearmost reflector with respect to said feeds is profiled or shaped to generate a contoured or shaped beam so as to have a footprint which covers only a predetermined area of ground.

Advantageously said feeds each comprise at least one feed, located near to the focus of its associated reflector.

Preferably the two reflectors are located rotated about a common axis or otherwise displaced so as to provide for a desired separation distance between the foci of the two reflectors.

Conveniently the feeds of one or both reflectors is/are interfaced to diplexers 12, 13 to permit combined transmit and receive operation of the assembly.

Advantageously the conducting grids 10 on the front most reflector with respect to the feeds are located such as to appear parallel to one another when projected onto a plane perpendicular to the direction of a boresight of the assembly.

DESCRIPTION OF THE DRAWINGS

For a better understanding of the present invention, and to show how the same may be carried into effect, reference will now be made, by way of example, to the accompanying single figure drawing in which.

DESCRIPTION OF EMBODIMENTS OF THE INVENTION

Figure 1:
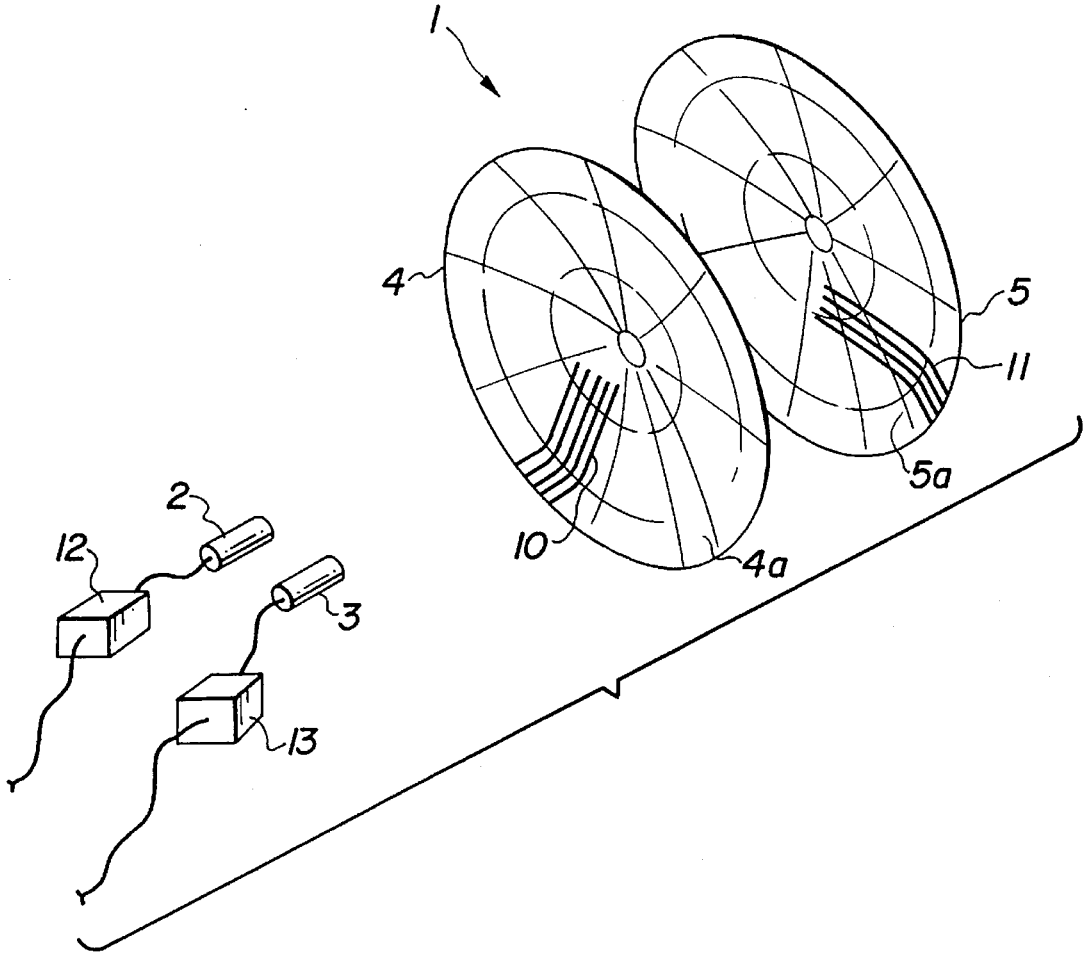
FIG. 1 is a diagrammatic view of a reflector antenna assembly according to one embodiment of the present invention for dual linear polarization.

A reflector antenna assembly according to the present invention, generally referenced at 1 in the accompanying drawings, for dual linear polarization, includes at least two feeds 2 and 3 and two reflectors 4 and 5. At least one of the reflectors 4 has a surface 4*a* which is nominally electrically transparent to linearly polarized radiation in one direction and is located in front of the other reflector 5 so as to be closer to said feeds 2 and 3. Additionally, at least one of the reflectors 4 and 5 is profiled or shaped in a manner such as to enable it to generate at least one complex contoured beam whilst using one of said feeds 2 and 3.

The reflector 4 is located in front of the reflector 5 and preferably has conducting grids 10 on the surface 4*a* so as to remain transparent to signals polarized orthogonally to the grids whilst being able to reflect signals polarized parallel to the grids. Such conducting grids 10, 11 are located to appear parallel to one another when projected onto a plane perpendicular to the direction of a bore sight of the assembly.

According to one embodiment of the invention the rearmost reflector 5 has, on a surface 5*a* thereof, conducting grids 11 extending in a direction orthogonal to the conducting grids 10 on the front reflector 4. Alternatively according to a further embodiment of the invention the rearmost reflector 5 may be uniformly electrically conducting.

The conducting grids 10, 11 may be metallic strips formed such as by printing and etching on to an originally radio frequency (RF) transparent reflector to enable it to be electrically conductive in a direction parallel to the strip like grids, while remaining non-conductive in a direction orthogonal to the strip like grids. This enables the reflector so provided to reflect fields polarized in the strip direction, but to be transparent to the other polarization. Grid strips suitable for some applications would be 0.3 mm in width at a spacing of 1.2 mm.

According to a further embodiment of the invention the front reflector 4 is profiled or shaped to generate a contoured or shaped beam so as to have a footprint which covers only a predetermined area of ground. Such shaping means that the reflecting surface is distorted away from a regular shape such as a basic conic section profile or a paraboloid of revolution and may be complex in form derived from an optimization algorithm so that the contoured beam generated thereby satisfies a particular performance specification. Additionally or alternatively the rearmost reflector 5 may be profiled or shaped such as to generate a contoured or shaped beam with the shaping or profiling being carried out in a complex manner in any convenient way such as derived from an optimization algorithm. The shaping or profiling may produce an irregular distortion of the whole reflector surface.

The two feeds 2 and 3 each comprise at least one feed, located near to the focus of its associated reflector. Thus feed 2 is associated with the front reflector 4 and feed 3 is associated with the rearmost reflector 5.

The two reflectors 4 and 5 are located rotated about a common axis or otherwise displaced so as to provide for a desired separation distance between the foci of the two reflectors. Conveniently the feeds 2 or 3 of one or both of the reflectors 4 and 5 is/are interfaced to diplexers 12, 13 to permit combined transmit/receive operation of the assembly 1.

The front reflector 4 which is nominally electrically transparent before gridding is preferably manufactured from Kevlar. The gridding process for either the front reflector 4 or rear reflector 5 can be carried out in any convenient manner and preferably involves metallization by vacuum deposition of aluminium followed by laser etching of the grids.

The antenna assembly of the present invention has considerable advantages over the conventional dual offset shaped reflector assembly and conventional offset gridded antenna assemblies previously described. For example in respect to the conventional dual offset dual reflector assembly, the assembly of the present invention has greater compactness and case of spacecraft accommodation basically arising from the elimination of the need for a subreflector. This may result in a considerable mass savings. Additionally, the assembly of the present invention is far less sensitive to thermal and other misalignments which usually result from the presence of the subreflector in the dual offset antenna assembly.

The dual offset shaped reflector antenna assembly in conventional form requires a high quality corrugated feeds since cross-polarization introduced at the feeds level cannot subsequently be eliminated. Dual polarization is obtained by incorporating an OMT into the feed chain. Great care must be exercised in the design of this OMT to minimize cross polarization. On the contrary, the antenna assembly of the present invention has a much simpler feed system in which separate feeds are used for the two polarizations thus eliminating the need for the OMT. Additionally, since the cross polarization is actively suppressed by the reflector, the quality of the feeds is relatively unimportant. Therefore, compact smooth walled feeds may be used which greatly reduces the cost and mass. Additionally, the reduction in feed size resulting from the use of smooth walled feeds makes the antenna assembly of the present invention more suitable for multiple beam applications.

Finally, since different reflectors are used for different polarizations in the antenna assembly of the present invention, the concave front surface of the first reflector can have a first shape different from a second shape of concave front surface of the second reflector to generate different contoured beam shapes having footprints which cover only predetermined areas of ground on the two polarizations. This is not possible in the conventional dual offset shaped reflector assembly.

In comparison with the conventional offset gridded antenna assembly, the antenna assembly of the present application has the following advantages which mainly result from the reduction in the number of feeds to a single feed where a single contoured beam is to be generated. This leads to an absence of feed mutual coupling effects which are hard to predict when the feeds are of different sizes, resulting in discrepancies in pattern shape between predicted and measured beam patterns. Such reduction in the number of feeds with the antenna assembly of the present application results in the absence of beam forming network losses usually present in the conventional offset gridded antenna assemblies which reduce the gain of multi feed antenna assemblies.

Moreover, with the antenna assembly of the present invention there is a reduction in spill over losses which result from feed array grating lobes which do not fall onto the reflector and the possibility of generating overlapping beams without feed sharing which results from the use of a single compact feed for each beam.

Various modifications and alterations may be made to the embodiments of the present invention described and illustrated, within the scope of the present invention as defined in the following claims.

What is claimed:

1. A reflector antenna assembly for dual linear polarization, comprising:

first feed means for feeding a first feed signal;

a first grid reflector having a distorted substantially concave front surface which is nominally electrically transparent to linearly polarized radiation in a first direction and having a first grid reflector focus, said distorted substantially concave front surface being non-symmetrical symmetrical about a boresight of said first grid reflector, said first feed means being disposed near said first grid reflector focus, and said first grid reflector focus being complex in location with respect to a plane perpendicular to said boresight of said first grid reflector;

second feed means for feeding a second feed signal; and a second reflector having a substantially concave front surface which is nominally reflective to linearly polarized radiation in said first direction and having a second reflector focus, said second feeds being disposed near said second reflector focus, and said first grid reflector being disposed between said second reflector and said first and second feeds;

said distorted substantially concave front surface of said first grid reflector having a first shape different from a second shape of said substantially concave front surface of said second reflector, said distorted substantially concave front surface of said first grid reflector being distorted in such a way that said first grid reflector generates a first beam with a footprint which covers only a predetermined area of ground; and at least one of said first shape of said first grid reflector and said second shape of said second reflector causing said first beam of said first grid reflector to overlap spatially a second beam projected by said second reflector.

2. A reflector antenna assembly according to claim 1, wherein:

said first grid reflector has a plurality of conducting grids on said front surface, said plurality of conducting grids being electrically transparent to radiation polarized orthogonally to said plurality of conducting grids and said plurality in a second direction parallel to said plurality of conducting grids.

3. A reflector antenna assembly according to claim 2, wherein:

said second reflector has a plurality of conducting grids on said substantially concave front surface extending in said first direction orthogonal to said plurality of conducting grids on said first grid reflector.

4. A reflector antenna assembly according to claim 1, wherein:

said substantially concave front surface of said second reflector nominally reflects radiation polarized in a second direction perpendicular to said first direction.

5. A reflector antenna assembly according to claim 1, wherein:

said substantially concave front surface of said second reflector is distorted; and said second reflector focus is complex in location with respect to a plane perpendicular to said boresight of said second reflector.

6. A reflector antenna assembly according to claim 1, wherein:

said first feed means and said second feed means each comprise at least one signal feed.

7. A reflector antenna assembly according to claim 6, wherein:

said first grid reflector and said second reflector are rotated about a common axis providing for a predetermined distance between said first grid reflector focus and said second reflector focus.

8. A reflector antenna assembly according to claim 1, wherein:

said first feed means is interfaced to a first diplexer to permit a transmit and receive operation of said reflector antenna assembly.

9. A reflector antenna assembly according to claim 1, wherein:

said first grid reflector has a plurality of conducting grids thereon which are located to appear parallel to one another when projected onto said plane perpendicular to said boresight of said first grid reflector.

10. A reflector antenna assembly according to claim 1, wherein:

said second feed means is interfaced to a second diplexer to permit a transmit and receive operation of said reflector antenna assembly.

11. A reflector assembly for dual linear polarization comprising:

a first grid reflector having a distorted substantially concave front surface which is nominally electrically transparent to linearly polarized radiation in a first direction and having a first grid reflector focus, said distorted substantially concave front surface being non-symmetrical about a boresight of said first grid reflector, said first grid reflector having a first grid reflector focus which is complex in location with respect to a plane perpendicular to said boresight of said first grid reflector;

a first feed disposed near said first grid reflector focus and providing a first feed signal;

a second reflector having a substantially concave front surface which is nominally reflective to linearly polarized radiation in said first direction and having a second reflector focus; and a second feed disposed near said second reflector focus and providing a second feed signal;

said first grid reflector being disposed between said second reflector and said second feed;

said distorted substantially concave front surface of said first grid reflector having a first shape different from a second shape of said substantially concave front surface of said second reflector, said distorted substantially concave front surface of said first grid reflector being distorted in such a way that said first grid reflector generates a first beam with a footprint which covers only a predetermined area of ground; and at least one of said first shape of said first grid reflector and said second shape of said second reflector causing said first beam of said first grid reflector to overlap spatially a second beam projected by said second reflector.

12. A reflector antenna assembly according to claim 11, wherein:

said substantially concave front surface of said second reflector is distorted; and said second reflector focus is complex in location with respect to a plane perpendicular to said boresight of said second reflector.

* * * * *